United States Patent [19]

Kreinbihl et al.

[11] Patent Number: 4,484,739

[45] Date of Patent: Nov. 27, 1984

[54] PLASTIC SLIDE FOR SLEDS

[75] Inventors: Mark L. Kreinbihl, Mansfield; Robert P. Miller, Wooster, both of Ohio

[73] Assignee: Wavetek International, Inc., Mansfield, Ohio

[21] Appl. No.: 475,452

[22] Filed: Mar. 15, 1983

[51] Int. Cl.[3] ..... A63G 21/18

[52] U.S. Cl. ..... 272/56.5 R; 104/70

[58] Field of Search ..... 272/56.5 R, 56.5 SS; 104/59, 69, 70, 72, 73, 134; 182/48; 193/11, 25 A, 25 R, 25 E, 2 R

[56] References Cited

U.S. PATENT DOCUMENTS

| | | | |
|---|---|---|---|
| 419,860 | 1/1890 | Libbey | 104/73 |
| 695,444 | 3/1902 | Carson et al. | 272/56.5 R |
| 824,436 | 6/1906 | Pester . | |
| 1,417,594 | 5/1922 | Coe . | |
| 1,441,126 | 1/1923 | Sherman . | |
| 1,648,196 | 11/1927 | Rohmer | 104/70 |
| 2,446,905 | 8/1948 | Buffum | 272/56.5 R |
| 3,362,755 | 1/1968 | Macks | 272/56.5 SS X |
| 3,690,265 | 9/1972 | Horibata | 104/70 |
| 4,199,142 | 4/1980 | Reick | 272/56.5 R |
| 4,337,704 | 7/1982 | Becker et al. | 272/56.5 R |
| 4,339,122 | 7/1982 | Croul | 104/70 |

FOREIGN PATENT DOCUMENTS

| | | | |
|---|---|---|---|
| 146390 | 2/1981 | German Democratic Rep. | 272/56.5 SS |

*Primary Examiner*—Robert A. Hafer
*Assistant Examiner*—Arnold W. Kramer
*Attorney, Agent, or Firm*—Pearne, Gordon, Sessions, McCoy, Granger & Tilberry

[57] ABSTRACT

A slide structure for sleds for human occupancy is disclosed, and is designed to have human occupant sleds sliding down into a body of water. The slide structure has a support framework on which a plastic sheet material is provided and a water supply means supplies only a thin film of water to the upper surface of the plastic sheet material. This conserves power and water, yet the thin film provides a very low coefficient of friction, so that the sleds attain a high speed for a quiet, fast, smooth, and more exciting ride, yet with reduced wear on both the slide and sleds.

15 Claims, 11 Drawing Figures

PLASTIC SLIDE FOR SLEDS

BACKGROUND OF THE INVENTION

A slide for sleds or small toboggans for human occupancy has previously been used and sold in the United States. This slide led toward a pool of water so that the human occupant sled would accelerate down the slide and then skim across the surface of the body of water, as an amusement ride. Such slide had a sled support surface comprised of a series of rollers set transversely of the path of the slide, and more specifically each roller was an aluminum tube journaled at each end on a fixed shaft in the slide support structure. The slide had a curved lower section and it was found that the rollers wore out from use, especially those rollers in the curved lower section which were subjected to high G forces and high acceleration forces from the successive sleds. Also, bearing failures resulted even though many different forms of bearings were tried, including ball bearings with steel balls, roller bearings with steel rollers, plain bearings, nylon bearings, and oil-impregnated wooden plain bearings. The latter appeared to be generally the most satisfactory; however, they still were subject to bearing failure and to wearing through of the 0.060 wall thickness of the aluminum rollers, especially at the curved lower section. Also, such rollers were noisy in operation, which was sometimes a liability in a quiet area. In addition, the rollers had spaces therebetween and there was always the concern that a person might get his hand or foot down between such rollers. A principal reason that the lower section rollers seemed to wear much more quickly than the upper section rollers was that the sled had accelerated to a high speed by the time it struck each of the lower section rollers in succession, and such rollers had to be accelerated almost instantaneously to the speed of the sled; otherwise, there was sliding contact between the roller surface and the sled rather than a rolling contact. Additionally, the heavier the bearing, the harder it was to accelerate the roller to the speed of the sled. This seemed to limit the terminal velocity of the sled off the lower section of the slide, and hence limited the distance which the sled would coast across the water surface.

Other water slides have been in operation and are generally of two different types. The first type is one which curves laterally, is usually made from fiberglass-reinforced resin plastic, and may have a generally semicircular cross section. This type of slide is meant for body sliding without any protective mat or sled. The second type is one made from sprayed concrete, such as gunite, again which may be laterally curving and have a generally semicircular cross section. Since the surface of this concrete-lined slide is rather rough, a protective mat is used to protect the person sliding down into a pool of water. The problems with these two types of slides are economic: they require a large volume of water, namely around 300–500 gallons per minute with the first type and 600–950 gallons per minute with the second type. When the water must be pumped up 30 to 40 feet, the expense for the pumping of this large volume of water makes the operation of the water slide generally prohibitive unless a large number of people are utilizing the slide.

Accordingly, the problems to be solved are how to reduce the wear on both the slide and the sleds, how to make the sled ride more smoothly, how to make the ride more exciting and faster, and how to make the sled coast further across the water while making the ride safer.

SUMMARY OF THE INVENTION

The problem is solved by a slide structure for sleds for human occupancy, comprising in combination a support framework having a lower section adjacent a pool of water and having an upper section disposed at an acute angle from the horizontal, said support framework having two sidewalls and a base adapted to support a human occupancy sled in a downwardly sliding path, plastic sheet material on said support structure base and having an upper surface adapted to be slidably engaged by the sleds, path guide portions of said plastic sheet material extending longitudinally relative to said slide structure base to be engageable by a sled should the sled deviate from the median path down the slide, a manifold connected at the undersurface of said plastic sheet material closely adjacent the top end of said slide support framework, means to supply water under pressure to said manifold, and a plurality of holes through said plastic sheet material at said manifold to serve as a water exit from said manifold to the upper surface of said plastic sheet material so that water will form a film on at least that part of the upper surface slidably engageable by the sleds.

A feature of the invention is to provide a slide structure with a wetted plastic film surface so that there is a sliding friction between the plastic-surfaced sleds and the plastic-surfaced slide structure.

Another feature of the invention is to provide a plastic-surfaced slide structure at the sled-to-slide engaging surfaces for a fast, smooth amusement ride.

Accordingly, an object of the invention is to provide a water supply to the upper slide surface of a plastic-surfaced slide or sleds, so that a film of water reduces the friction, yet a torrent of water is not required and, hence, the slide is economically operated.

BRIEF DESCRIPTION OF THE DRAWINGS

Other objects and a fuller understanding of this invention may be had by referring to the following description and claims, taken in conjunction with the accompanying drawings, in which:

DESCRIPTION OF THE PREFERRED EMBODIMENT

Figures 1, 2, 3, 4, 5:
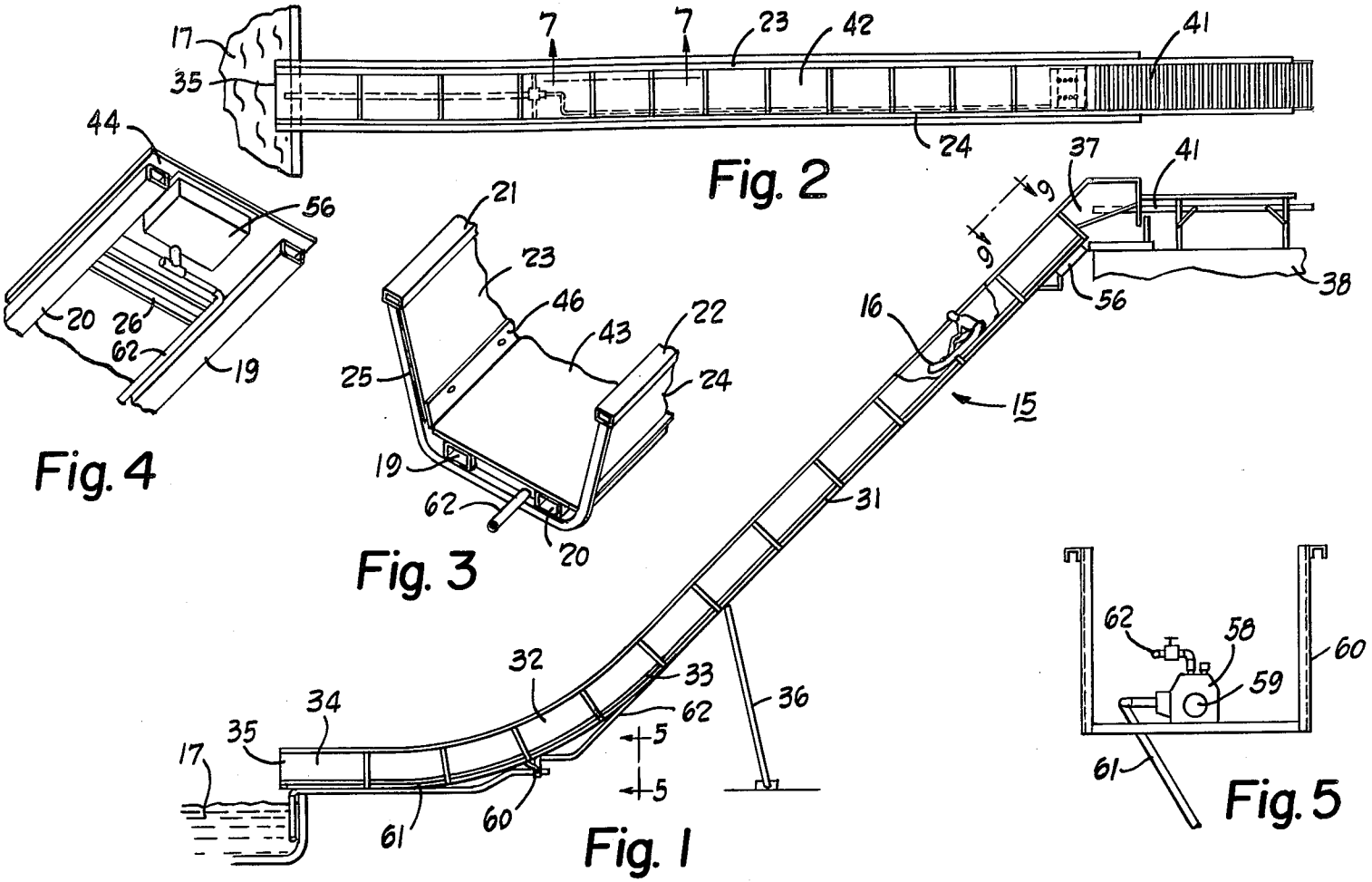
FIG. 1 is a side elevational view of a slide structure constructed according to the invention.
FIG. 2 is a plan view of the slide structure of FIG. 1.
FIG. 3 is an enlarged, partial, perspective view of the slide structure.
FIG. 4 is an enlarged, partial, perspective view of the underside of the upper section of the slide structure.
FIG. 5 is an enlarged view on line 5—5 of FIG. 1.

The figures of the drawing illustrate a slide structure 15 which is usable for sleds for human occupancy, one of the sleds 16 being illustrated in FIG. 1. The slide may be designed to have the human occupant sled slide down a pathway onto a generally horizontal slipping surface, such as a body of water 17. The slide structure 15 includes a support framework 18 which includes four longitudinal rails 19, 20, 21, and 22. The four rails are generally parallel, with the rails 19 and 20 providing a base and the upper rails 21 and 22 providing upper edges to sidewalls 23 and 24. These longitudinal rails may be of rectangular cross section steel tubing and are joined to U-shaped structural angles 25 by a suitable means, such as welding. These U-shaped structural angles may be placed at intervals along the length of the support framework 18, e.g., at five-foot intervals. Inverted U-shaped channels 26 extend between the lower longitudinal rails 19 and 20 and are secured thereto by suitable means, such as welding. These channels 26 are spaced at intervals along the length of the support framework, e.g., a spacing of 28–34 inches. Structural angles 27 and 28 extend longitudinally along each side of the support framework between successive U-shaped structural angles 25, and are secured thereto by suitable means, such as welding. The structural angles and channels may be made of steel, and the sidewalls 23 and 24 may be made of sheet material, e.g., 0.080-inch aluminum sheets secured to such structural angles 25, 27, and 28. The succession of inverted U-shaped channels and the top of the lower longitudinal rails 19 and 20 provide a base 30 of the support framework 18.

As better illustrated in FIG. 1, the slide structure 15 has a straight but inclined upper section 31 and a lower section 32. The upper section is at an acute angle to the horizontal, e.g., 45°. The lower section 32 has a curved or radius portion 33 and a horizontal portion 34 terminating at a lower end 35 of the slide structure a slight distance above the nominal surface of the water. The horizontal portion 34 of the slide structure 15 may be supported on a suitable foundation on the ground, a support column 36 may support the slide structure generally at the junction of the upper and lower sections 31 and 32, and the upper end 37 of the slide structure may be supported on a support tower 38, the details of which are not illustrated.

Figure 6:
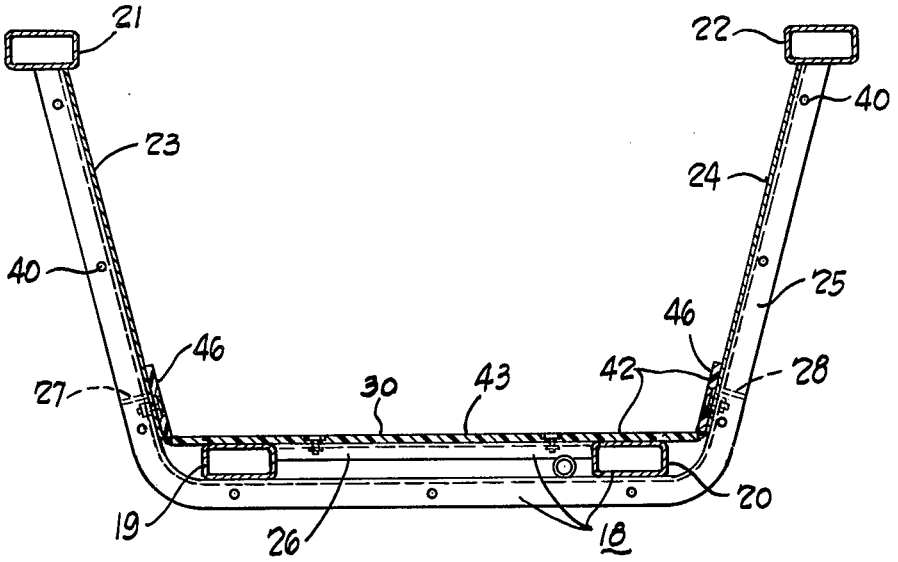
FIG. 6 is an enlarged, cross-sectional view of the slide structure.

The upper section 31 may be constructed as one unit at the factory, and the lower section 32 may be constructed as another separate unit. At the adjoining ends of these two sections, each section may have a U-shaped structural angle 25, as shown in FIG. 6, which includes holes 40 through which bolts may be inserted and nuts supplied to secure together the upper and lower sections 31 and 32 during erection and completion at the pool site. A suitable sled-starting gate 41 may be provided at the slide upper end 37.

Figure 10:
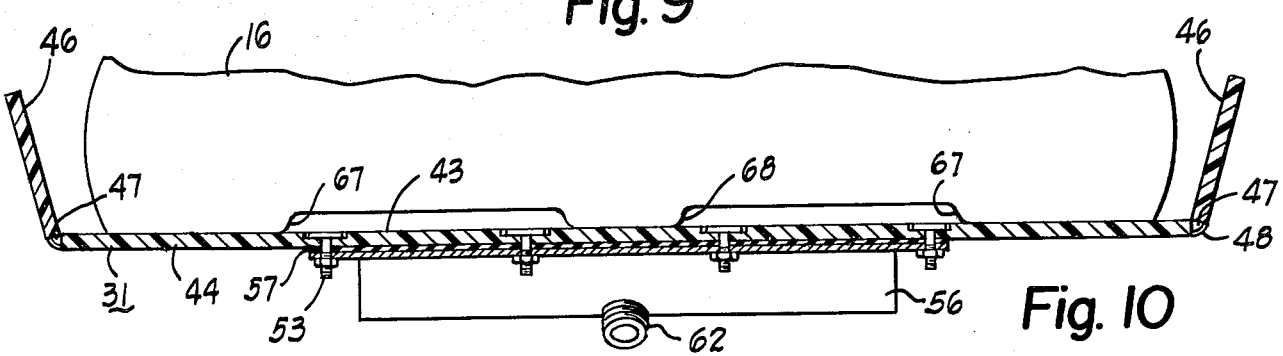
FIG. 10 is a cross-sectional view on line 10—10 of FIG. 9.
Figure 11:
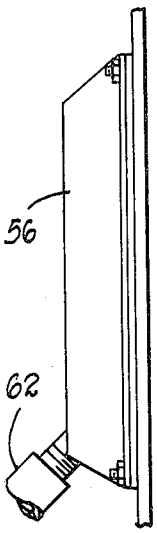
FIG. 11 is a side view of FIG. 9.

The slide structure 15 includes plastic sheet material 42 which is mounted on the support structure base 30 of the lower rails 19 and 20 and channels 26. This plastic sheet material has an upper surface 43 as a sled-engageable surface. In this preferred embodiment, the plastic sheet material 42 is in the form of relatively rigid slabs of plastic, of an ultra high molecular weight polyethylene which may be ⅜ inch thick, for example, and cover the entire 29-inch width of the base of the slide structure. This is better shown in FIG. 10. Path guide portions 46 of said plastic sheet material extend longitudinally relative to the slide structure base to be engageable by the sides of the sleds 16 should the sleds deviate from the median pathway down the slide. FIG. 10 shows a partial sectional view through the upper slide section 31, and in this case the preferred embodiment is that the plastic slabs 44, which form the base of the slide and have the upper surface 43 for engagement by the sleds 16, are unitary with the path guide portions 46. To accomplish this, a longitudinal slot 47 is milled near each edge of the slabs 44 and the sides bent upwardly at these slots, which form unitary hinge portions 48, permitting such bending. This is also shown in FIGS. 3, 6, and the right half of FIG. 8. Since the plastic slabs are relatively rigid, they span the distance between the longitudinal rails 19 and 20 and between the successive channels 26, and provide a good floor or base for the sleds 16.

In the curved portion 33 of the lower section 32, the construction is different. This construction is shown in the left half of FIG. 8, wherein the plastic slabs 44A extend completely across the base of the slide, but are not unitary with the path guide portions 46A. These path guide portions 46A are separately formed from curved pieces, such as better shown in FIG. 7, in order to fit the contour of the curve along the sidewalls 23 and 24. The base slabs 44A are also curved in a single plane to match the curve of the longitudinal rails 19 and 20. A watertight sealer, such as a silicone sealer 49, is used to join the plastic slabs 44A and path guide portions 46A. The right half of FIG. 8 shows the construction in the upper section 31 of the slide structure 15.

Figures 7, 8:
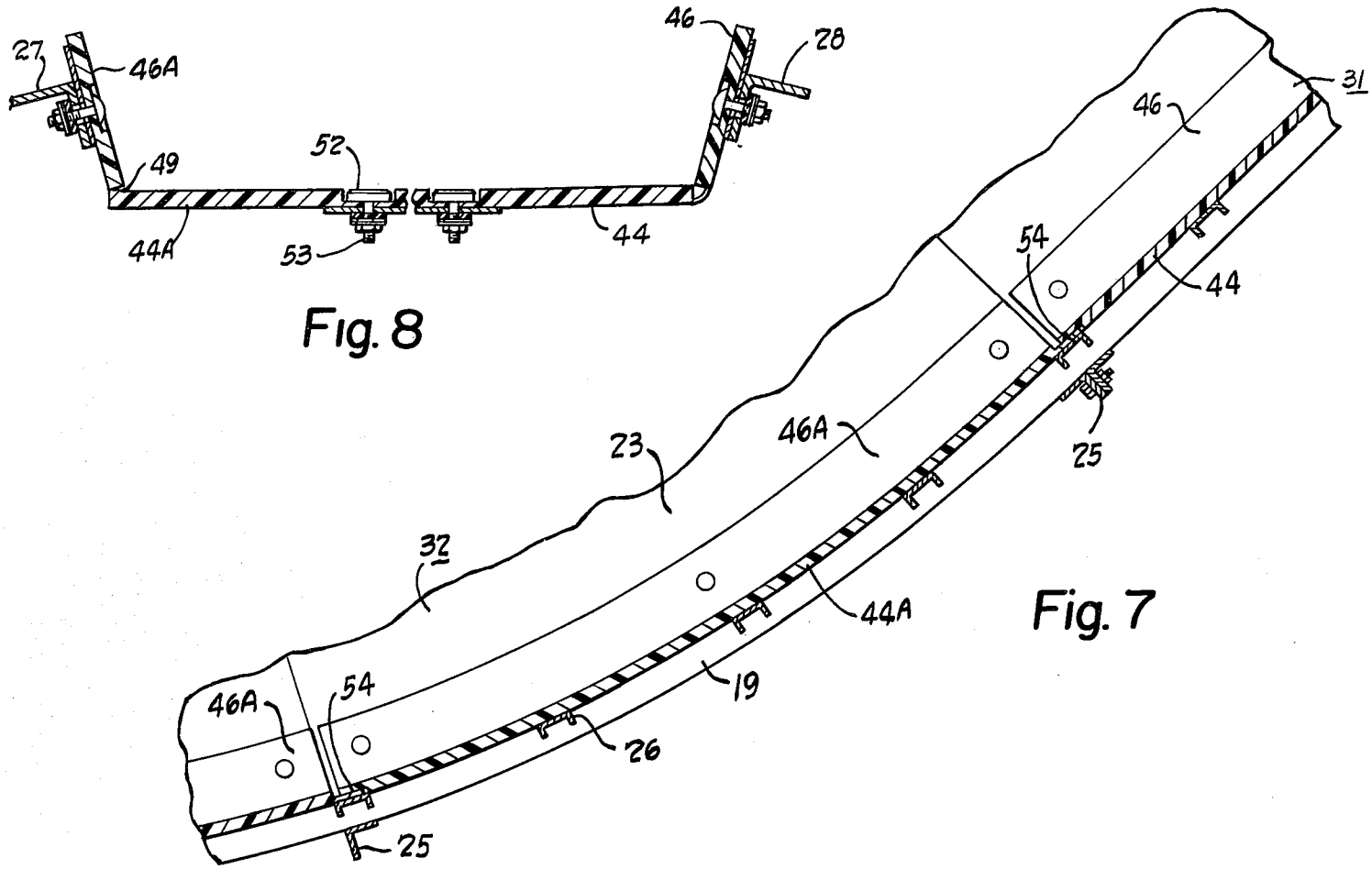
FIG. 7 is an enlarged, longitudinal sectional view on line 7—7 of FIG. 2 to show the base of the slide structure.
FIG. 8 is an enlarged, cross-sectional view of two different portions of the plastic slabs on the slide structure.

FIG. 8 also shows details of construction wherein plastic-capped heads 52 on bolts 53 are recessed into the plastic slabs and secure the slabs in place. The countersunk holes into which the bolt heads are recessed are slightly larger than the bolt heads to permit expansion movement of the plastic slabs, since the coefficient of expansion of the UHMW polyethylene is about eleven times that of steel. Also, the hinge portions 48 permit this expansion and contraction with temperature changes.

The plastic slabs 44 and 44A may be of some practical length, e.g., five feet, and successive plastic slabs have a ship-lap joint 54, to be watertight.

Figure 9:
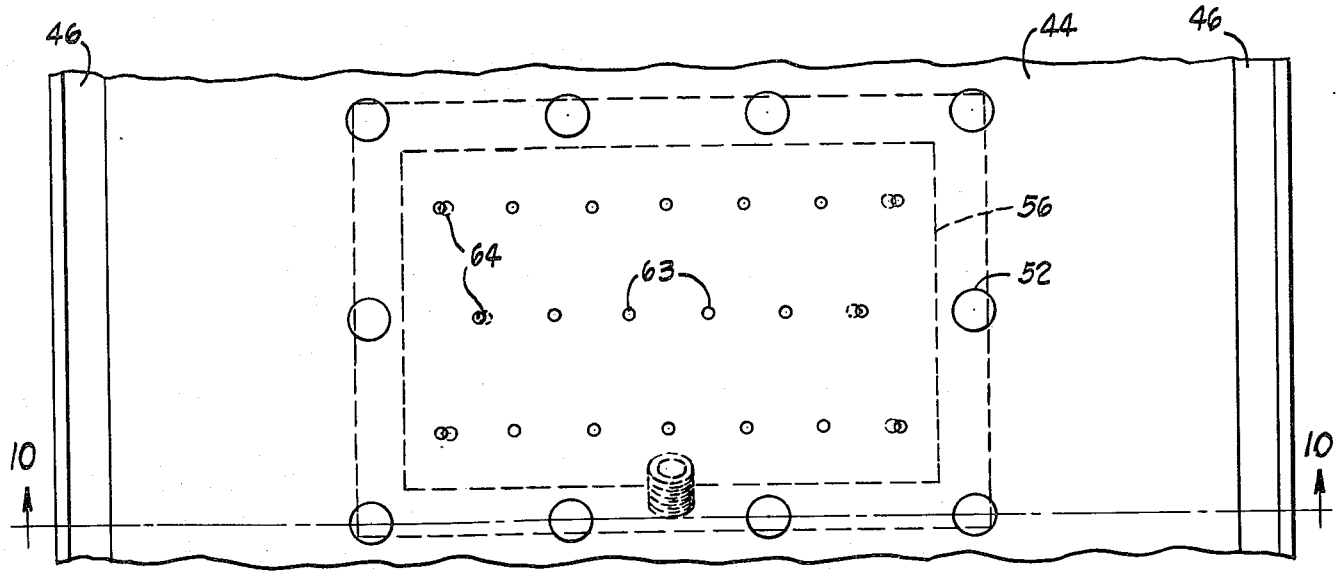
FIG. 9 is an enlarged, partial view on line 9—9 of of FIG. 1.

Means is provided to supply a film of water on the upper surface 43, and this greatly reduces the friction between the slide and sled. This water film supply means includes a manifold 56, which is connected at the undersurface of the uppermost plastic slab 44. It is connected to the undersurface of this plastic slab closely adjacent the top end of the slide support framework 18, and fits between the lower longitudinal rails 19 and 20. A gasket 57 and the plastic-capped bolts 53 are used to secure the manifold to this undersurface in a watertight manner. Water supply means for the manifold 56 is provided, which includes a water pump 58 driven by an electric motor 59. This pump and motor may conveniently be mounted on a bracket 60 suspended below the slide support framework in a suitable location on the lower section 32. The pump 58 has a water inlet conduit 61 leading to the water pool 17, and has an outlet conduit 62 leading to the manifold 56 to supply water under pressure to this manifold, which might be 30 or 35 feet in elevation above the pool. A plurality of holes 63 are provided through the plastic sheet material at the manifold to serve as a water exit from the manifold to the upper surface 43. The holes are disposed in at least one row, and FIG. 9 shows three rows in the preferred embodiment. The central holes in the plastic slab are perpendicular to that slab, but the end holes 64 in each row aim outwardly at about a 45° angle relative to the plastic slab to cause water to spurt laterally toward the proximate sidewall 23 or 24. This spreads the water outwardly so that it forms a film over the entire upper surface 43.

The ship-lap joints 54, the sealant 49, and the unitary hinge portions 48 provide a watertight, upper surface 43 so that the film of water spread across the width of the slide at the top remains a film of water on the entire slide surface throughout its length.

The sled 16 is partially shown in FIG. 10, and in the preferred embodiment is made from a molded cross-linked polyethylene with outer runners 67 of about five-inch width and a central runner 68 of about 3-inch width. This makes a total of about 13 lateral inches of runner width which may engage the upper surface 43, and the water film supplied by the manifold 56 and pump 58 is designed to provide a water film about 1/32" to ¼" deep on at least this slide-to-sled engaging surface. Since the slide-to-sled engaging surface is only about 13 lateral inches out of the about 29-inch width of the slide base, this is a water supply means which supplies water at a rate in the range of about one-half to one gallon per minute per lateral inch of slide-to-sled engageable surface.

The prior art water slides, made of concrete, and which required a foam mat for protection of the person sliding down the slide, required a much larger volume of water, in the order of 600–950 gallons per minute. The prior art water slides not requiring a protective mat or sled, and which were generally made of fiberglass-reinforced resin plastic, required even more water, in the order of 300–500 gallons per minute. This is a large volume of water considering the head of 30–40 feet against which the water volume must be pumped, and required pump motors in the order of 30–60 horsepower. The present pump 58 requires only a one-third horsepower electric motor for a 35-foot head, supplying 6–10 gallons per minute. Hence, this is a very great reduction in water flow, electrical power, and water filtration requirements for the water slide of the present invention.

The use of the water film on the UHMW polyethylene establishes the very low coefficient of friction of about 5–10% that of polished steel. Also the resitance to weight loss by abrasion is about five times better than tetrafluoroethylene and seven times better than that of high carbon steel. This combination of properties provides a water slide of the invention with greatly improved results compared to the old slide with rollers in the base on which the sled supposedly rolled. It was found that in the prior art slide constructions utilizing rollers, when the sled got to the lower curved section, it was traveling at a fast speed, and as the sled hit each individual roller it could not accelerate that roller to the speed of the sled instantaneously. Thus, there was sliding friction between the sled and the roller rather than merely rolling friction. Many different types of bearings were tried in the rollers, including steel ball bearings, steel roller bearings, plain bearings, nylon bearings, and oil-impregnated wooden plain bearings. The latter seemed to provide the best combination of results, yet the slide was noisy, having a noise rating of about 96 db at a distance of 100 feet. The present slide has been tested in operation and has only 56 db noise rating at the same 100-foot distance. This is a remarkable improvement, and permits installation and operation of the slide structure in quiet locations where loud noise would be objectionable. By eliminating the rollers, and by use of the plastic, the sled has a smoother ride, the wear is reduced on both slide and sleds, and the lower friction permits the sled to accelerate to a faster speed, allowing the sled to coast a longer distance on the water surface of the pool 17, so that the ride both down the slide and across the pool is more exciting. Also this results in an amusement ride which is safer because there is no space between the rollers into which a person might conceivably get his hand or foot caught.

In the prior art construction, some of the 0.060 inch thick aluminum rollers actually wore completely through and broke, and this was primarily at the lower curved section, where the speed of the sled was about the greatest and where the G force was the greatest.

In the prior art slides, the large electrical pumping power required made the water slide uneconomical to operate unless there was a large number of people continuously using the slide. This was satisfactory on a hot summer Sunday afternoon, but the present invention permits economical operation of the slide all day long and all week long when the amusement park is open to the public.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A slide structure for sleds for human occupancy, comprising in combination:
   - a support framework having a lower section adjacent a pool of water and having an upper section disposed at an acute angle from the horizontal;
   - said support framework having two sidewalls and a framework base;
   - plastic sheet material on said support structure base and having an upper surface adapted to be slidably engaged by human occupancy sleds;
   - path guide portions of said plastic sheet material extending longitudinally relative to said slide structure base to be engageable by a sled should the sled deviate from the median path down the slide;
   - a manifold connected at the undersurface of said plastic sheet material closely adjacent the top end of said slide support framework;
   - means to supply water under pressure to said manifold; and
   - a plurality of holes through said plastic sheet material at said manifold to serve as a water exit from said manifold to the upper surface of said plastic sheet material so that water will form a film on at least that part of the upper surface slidably engageable by the sleds.

2. A slide structure as set forth in claim 1, wherein said plastic sheet material includes at least one slab of relatively rigid plastic material covering said support framework base.

3. A slide structure as set forth in claim 1, wherein said plastic sheet material includes a plurality of relatively rigid side slabs of plastic material extending a short distance up the sides of said slide structure to be engageable by the sleds as said path guide portions.

4. A slide structure as set forth in claim 1, wherein said water supply means includes an electrically powered water pump mounted beneath the slide structure near the lower end;

an intake conduit leading from said pump to the pool; and an outlet pipe from the outlet of said pump to said manifold to supply water under pressure to said manifold.

5. A slide structure as set forth in claim 1, wherein said plurality of holes through said plastic sheet material are disposed at various angles relative to each other to direct water to the entire width of the plastic sheet material upper surface.

6. A slide structure as set forth in claim 5, wherein said plastic sheet material includes a plastic slab, said plurality of holes are in said plastic slab at said manifold and have the holes disposed in a row transverse to said slide structure with the holes at one end of the row directed at about a 45° angle to the slab in one lateral direction and the holes at the other end of the row directed at about a 45° angle in the other lateral direction relative to the plastic slab to direct water to the entire width of said upper surface.

7. A slide structure as set forth in claim 1, wherein said support framework has the upper section thereof disposed along a plane at about a 45° angle to the horizontal and the lower section thereof has a curved portion terminating in a substantially horizontal portion slightly above the nominal water surface level in the pool.

8. A slide structure as set forth in claim 7, wherein said plastic sheet material is in the form of relatively rigid plastic slabs with a plurality of such slabs on each of the upper and lower sections of the support framework.

9. A slide structure as set forth in claim 8, wherein said plurality of slabs have a ship-lap joint to the next adjacent plastic slab to retain water on said upper surface.

10. A slide structure as set forth in claim 8, wherein said plastic slabs on said upper section each have a base portion and unitary upwardly extending side-wall portions joined by reduced thickness hinge portions at the junction of said base and sidewall portions.

11. A slide structure a set forth in claim 8, wherein said plastic slabs on said curved lower section utilize separate base and sidewall portions curved to fit the contour of said support framework;

and a sealer between said separate base and sidewall portions of said lower section plastic slabs.

12. A slide structure as set forth in claim 1, wherein said plastic sheet material comprises an ultra high molecular weight polyethylene having a coefficient of friction of about 0.05 to 0.10 as lubricated with a water film relative to polished steel.

13. A slide structure as set forth in claim 1, wherein said plastic sheet material comprises an ultra high molecular weight polyethylene having a resistance to abrasion about seven times better than that of high carbon steel.

14. A slide structure as set forth in claim 1, wherein said water supply means supplies water at the rate of six to ten gallons per minute.

15. A slide structure as set forth in claim 1, wherein said water supply means supplies water at the rate in the range of about one-half to one gallon per minute per lateral inch of slide-to-sled engageable surface.

* * * * *